US010888176B2

(12) United States Patent
Reichert

(10) Patent No.: US 10,888,176 B2
(45) Date of Patent: Jan. 12, 2021

(54) HEAT ABSORBING DOOR FOR A REFRIGERATED MERCHANDISER

(71) Applicant: Hussmann Corporation, Bridgeton, MO (US)

(72) Inventor: Craig Steven Reichert, Saint Charles, MO (US)

(73) Assignee: Hussmann Corporation, Bridgeton, MO (US)

( * ) Notice: Subject to any disclaimer, the term of this patent is extended or adjusted under 35 U.S.C. 154(b) by 478 days.

(21) Appl. No.: 15/481,933

(22) Filed: Apr. 7, 2017

(65) Prior Publication Data

US 2017/0208966 A1 Jul. 27, 2017

Related U.S. Application Data

(63) Continuation of application No. 13/186,623, filed on Jul. 20, 2011, now abandoned.

(51) Int. Cl.

| | |
|---|---|
| ***A47F 3/04*** | (2006.01) |
| ***E06B 7/12*** | (2006.01) |
| ***E06B 3/67*** | (2006.01) |
| ***E06B 3/663*** | (2006.01) |
| ***A47F 3/00*** | (2006.01) |
| ***A47F 3/06*** | (2006.01) |

(52) U.S. Cl.

CPC ..... *A47F 3/0434* (2013.01); *A47F 3/001* (2013.01); *A47F 3/06* (2013.01); *E06B 3/66319* (2013.01); *E06B 3/6715* (2013.01); *E06B 7/12* (2013.01); *E06B 3/66366* (2013.01)

(58) Field of Classification Search

CPC ..... A47F 3/043; A47F 3/0434; A47F 3/04; H05B 3/06; H05B 3/84; E06B 3/66366; E06B 2003/6638; G02B 1/10; F25D 23/02

See application file for complete search history.

(56) References Cited

U.S. PATENT DOCUMENTS

| | | | | |
|---|---|---|---|---|
| 2,444,976 | A * | 7/1948 | Brown | 359/361 |
| 6,401,399 | B1 * | 6/2002 | Roche | A47F 3/0434 49/501 |
| 2002/0078654 | A1 * | 6/2002 | Richardson | A47F 3/0434 52/656.9 |
| 2006/0103269 | A1 * | 5/2006 | Artwohl | A47F 3/0434 312/116 |
| 2010/0062152 | A1 * | 3/2010 | Roche | C03C 17/322 427/164 |
| 2011/0100044 | A1 * | 5/2011 | Reichert | A47F 3/0434 62/246 |

* cited by examiner

*Primary Examiner* — Frantz F Jules
*Assistant Examiner* — Martha Tadesse
(74) *Attorney, Agent, or Firm* — Michael Best & Friedrich LLP

(57) ABSTRACT

A door for a refrigerated merchandiser including a case that defines a product display area. The door includes a frame and a first glass pane coupled to the frame. The first glass pane has heat-absorbing glass and is configured to be positioned adjacent an ambient environment surrounding the refrigerated merchandiser to absorb radiation from the ambient environment. The door also includes a second glass pane coupled to the frame and configured to be positioned adjacent the product display area. The second glass pane includes a conductive coating. The door further includes a third glass pane positioned between and spaced from the first glass pane and the second glass pane, and has a low emissivity coating.

17 Claims, 4 Drawing Sheets

HEAT ABSORBING DOOR FOR A REFRIGERATED MERCHANDISER

CROSS-REFERENCE TO RELATED APPLICATION

This application is a continuation of U.S. patent application Ser. No. 13/186,623, filed Jul. 20, 2011, which published as U.S. Publication No. 2013/0019616 on Jan. 24, 2013, which is incorporated herein by reference in its entirety.

BACKGROUND

The present invention relates to refrigerated merchandisers, and more particularly to doors for refrigerated merchandisers.

Refrigerated merchandisers are used by grocers to store and display food items in a product display area that must be kept at a predetermined temperature. These merchandisers generally include a cabinet with an integrated refrigeration unit and have multiple shelves supported within the product display area. Doors positioned along the front side of the merchandiser separate the product display area from the ambient external conditions and allow for consumer access to the contents within. The doors typically include one or more panes of glass configured to minimize heat transfer while providing unimpaired visual access to the product display area.

Due to the conditions of the environment in which they operate, refrigerated merchandisers are frequently susceptible to condensation on various surfaces. Condensation typically forms on the interior and exterior faces of the glass doors as ambient air with a certain moisture content contacts a surface that has been cooled below the dew point of that air. For example, a refrigerated merchandiser in a grocery store may have a glass door with multiple panes. The pane of glass adjacent the refrigerated interior will likely be below the dew point of the store side (ambient) air. Opening the door will expose the face of this relatively cold pane to the ambient air, resulting in condensation (e.g., "fogging") on this interior surface. In addition, the pane of glass on the store side of the door is also often at or below the dew point of the store side ambient air, which can lead to continuous condensation on this external glass surface, and, due to heat transfer between the glass and the surrounding door molding, can likewise create condensation on the cooled exterior molding surface as well.

The result of such condensation is the formation of visible water on the glass, which not only impedes the customer's line of sight from the exterior store side into the refrigerated interior, but which may also collect to form puddles of water near the door leading to a dangerous slippery condition for customers. To prevent condensation, conventional doors for refrigerated merchandisers typically include an electrically heated coating on the interior surface of the store-side glass to raise the temperature of the glass above the dew point of the store-side ambient air. But such a heated coating is constantly energized and consequently incurs energy costs for the store owner. And depending on where the coating is located on the glass surface, it may not provide sufficient heating to the surrounding door molding to hinder condensation on the molding.

SUMMARY

In one construction, the invention provides a door for a refrigerated merchandiser including a case that defines a product display area. The door includes a frame and a first glass pane coupled to the frame. The first glass pane has heat-absorbing glass and is configured to be positioned adjacent an ambient environment surrounding the refrigerated merchandiser to absorb radiation from the ambient environment. The door also includes a second glass pane coupled to the frame and configured to be positioned adjacent the product display area. The second glass pane includes a conductive coating. The door further includes a third glass pane positioned between and spaced from the first glass pane and the second glass pane, and has a low emissivity coating.

In another construction, the invention provides a refrigerated merchandiser including a case that defines a product display area, and a door coupled to the case and enclosing a portion of the product display area. The door includes a frame and a first glass pane coupled to the frame. The first glass pane has heat-absorbing glass and is positioned adjacent an ambient environment surrounding the refrigerated merchandiser to absorb radiation from the ambient environment. The door also includes a second glass pane coupled to the frame and positioned adjacent the product display area. The second glass pane includes a conductive coating. The door further includes a third glass pane positioned between and spaced from the first glass pane and the second glass pane, and has a low emissivity coating.

In another construction, the invention provides a method of preventing condensation on a door of a refrigerated merchandiser defining a product display area and surrounded by an ambient environment. The door includes a first glass pane that is positioned adjacent the ambient environment, a second glass pane that is positioned adjacent the product display area, and a third glass pane that is positioned between and spaced apart from the first pane and the second pane. The method includes absorbing radiation from the ambient environment and incident on the first glass pane, increasing the temperature of a surface of the first glass pane facing the ambient environment above the dew point of the ambient environment, heating the second glass pane, and reflecting radiation with a low emissivity coating affixed to the third glass pane.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
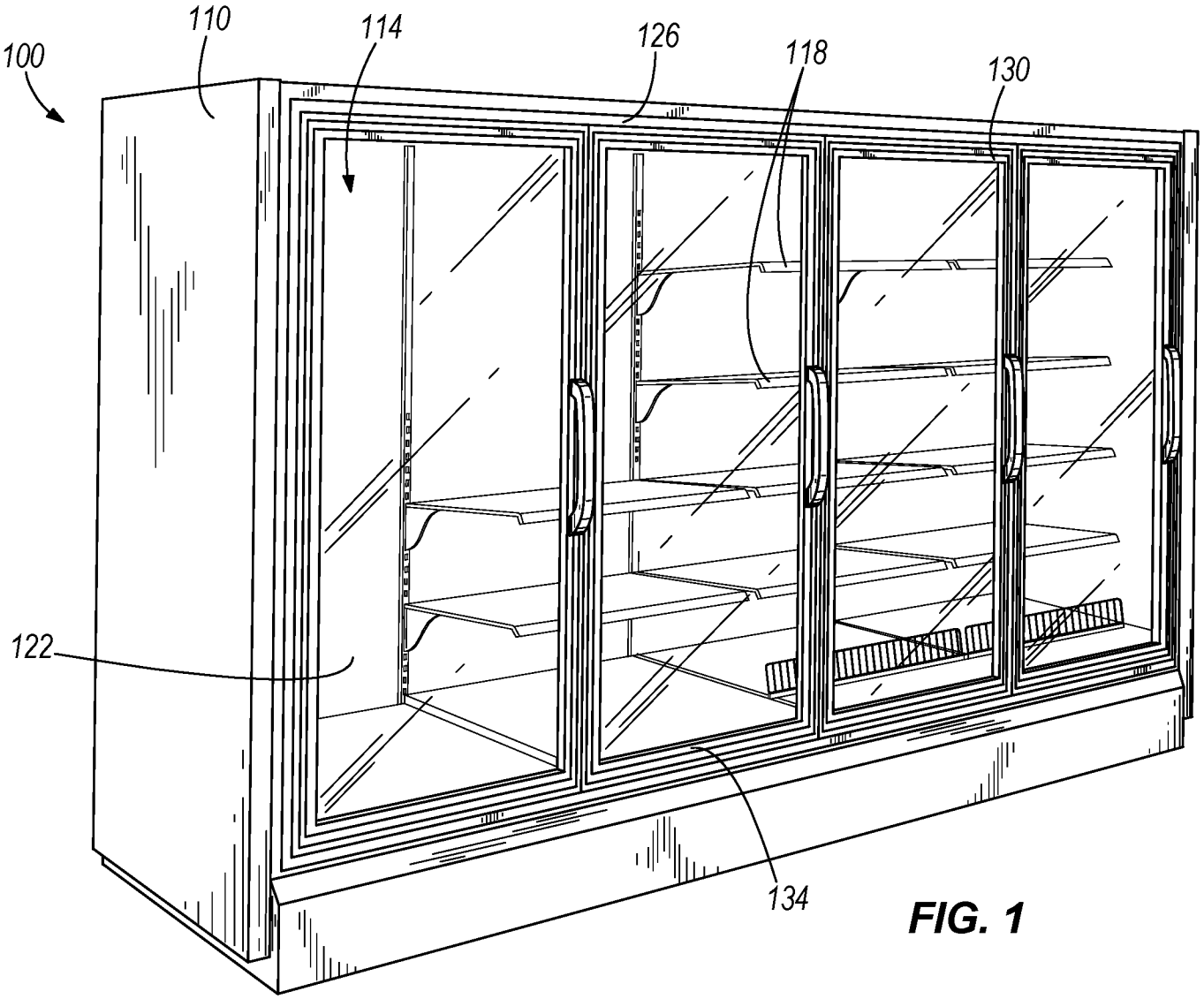
FIG. 1 is a perspective view of a refrigerated merchandiser embodying the present invention.

FIG. 1 illustrates a refrigerated merchandiser 100 including a cabinet 110 that defines an interior space or product display area 114. The product display area 114 is cooled by a refrigeration unit (not shown), the selection and placement of which will be readily appreciated by those of ordinary skill in this art. Adjustable shelves 118 within the product display area 114 are supported by a back wall 122 of the cabinet 110 for supporting product. As illustrated, a cabinet casing 126 along a front of the cabinet 110 surrounds and supports doors 130 that provide ingress to the product display area 114.

Figure 2:
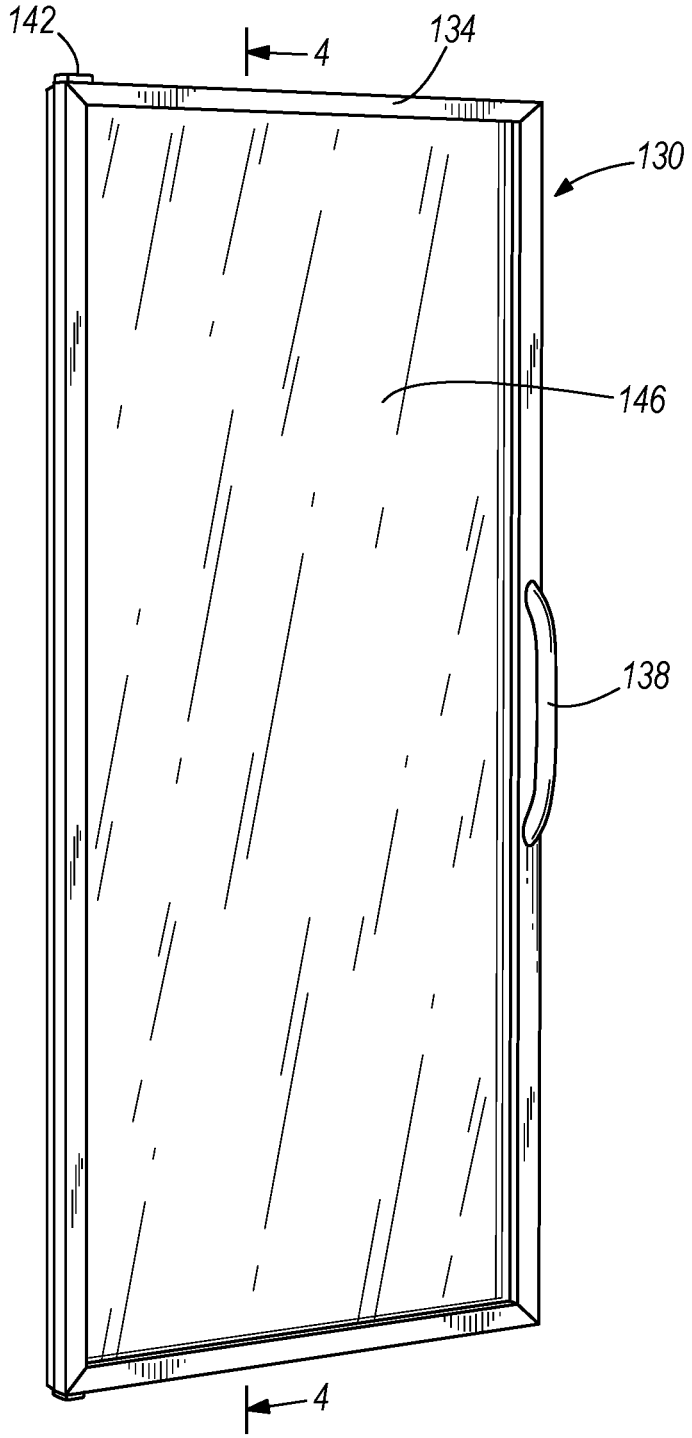
FIG. 2 is a perspective view of a door of the refrigerated merchandiser of FIG. 1.

With reference to FIG. 2, each door 130 has a door frame 134 and a handle 138 for opening and closing the door 130. A hinge 142 facilitates rotational movement of the door between a closed position and an open position. Alternatively, the door 130 may translate, or slide, in a track (not shown) in a plane substantially parallel to the front face 128 (FIG. 1). A glass assembly 146 separates the product display area 114 from air in the ambient environment 148 surrounding the refrigerated merchandiser 100. The terms "ambient air" and "ambient environment" are meant to include air adjacent and external to the front face 128 of the refrigerated merchandiser 100 and may include, for example, air within a grocery store or other retail setting, or outside air if the merchandiser 100 is outside a building.

Figure 3:
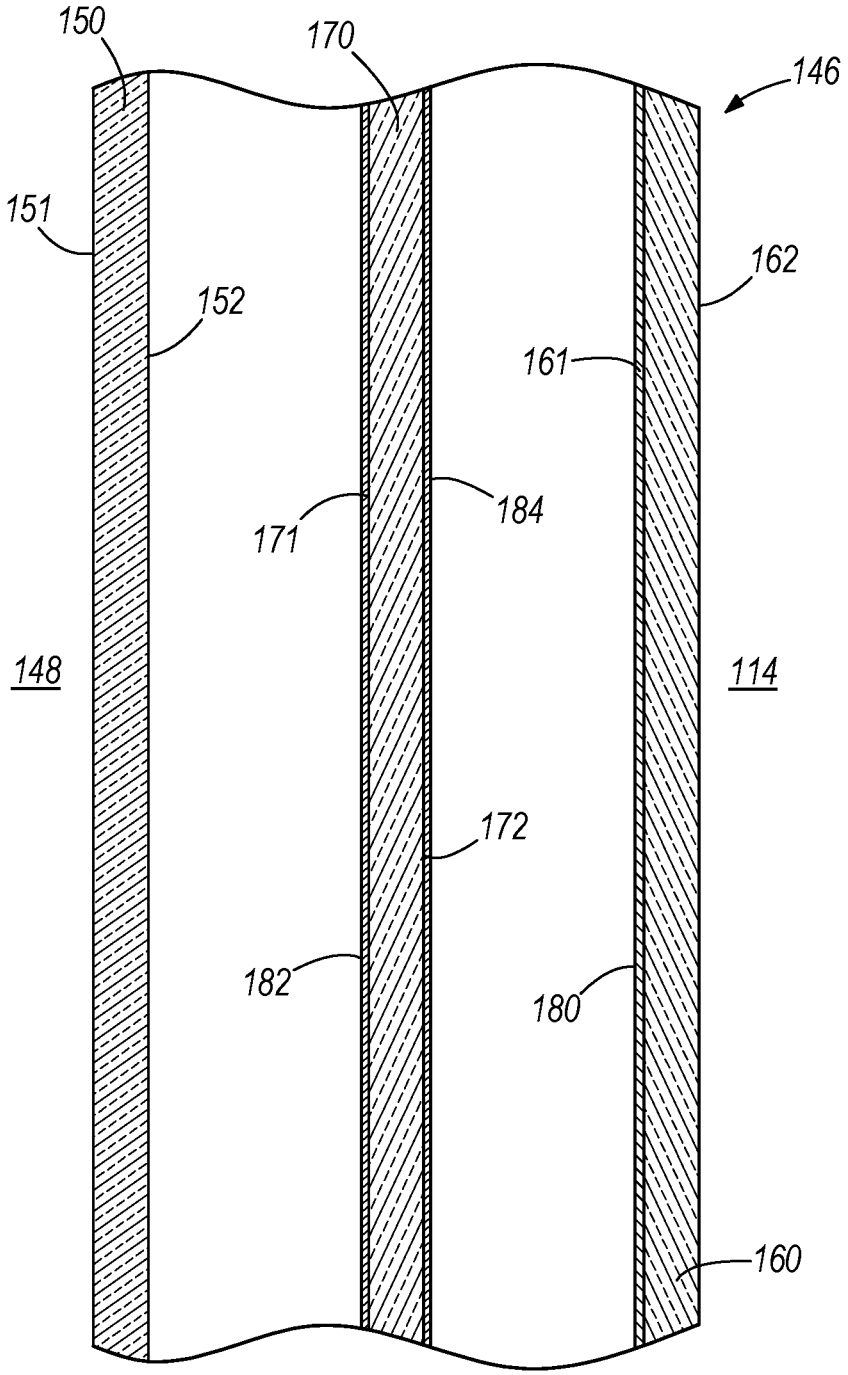
FIG. 3 is a section view of a portion of the door of FIG. 2.
Figure 4:
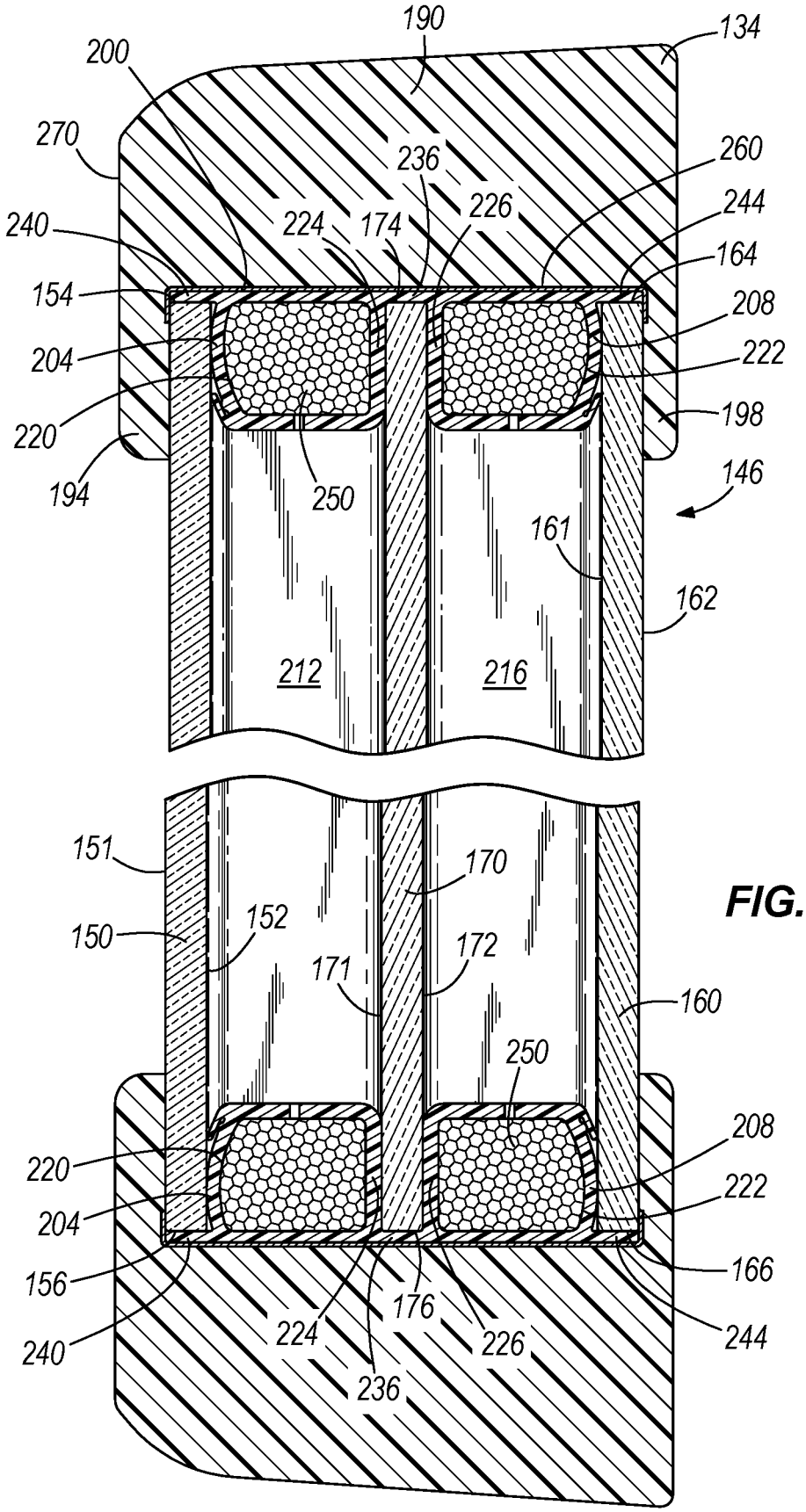
FIG. 4 is a section view of the door taken along line 4-4 of FIG. 2.

FIGS. 3 and 4 show that the glass assembly 146 includes a first or exterior glass pane 150 that is positioned adjacent the ambient environment 148, a second or interior glass pane 160 that is positioned adjacent the product display area 114, and a third or intermediate glass pane 170 that is positioned between the exterior glass pane 150 and the interior glass pane 160. In some constructions, the glass assembly 146 may include more than three glass panes (i.e., more than one intermediate glass pane 170).

The exterior glass pane 150 includes a first surface 151 that faces away from the product display area 114 and that is exposed to the ambient environment 148, and a second surface 152 opposite the first surface 151 that faces toward the product display area 114. The exterior glass pane 150 is formed of a heat absorbing glass, which absorbs a significant quantity of incident infrared radiation from the ambient environment 148 and consequently reduces the amount of infrared radiation transmitted through the glass. The term "heat-absorbing glass" means glass that is specifically constructed for such a purpose, and includes glass containing quantities of ferrous iron or other material selected to provide a similar effect. The term "radiation" encompasses radiation across the electromagnetic spectrum, including infrared, visible light, and ultraviolet radiation. Specifically, the heat absorbing glass pane 150 absorbs approximately 35-55% of incident infrared radiation or heat from the ambient environment 148 while allowing approximately 70-90% of visible light to be transmitted. Other ranges of both absorption and transmittance for the exterior glass pane 150 are possible and considered herein. Absorbed radiation retained within the glass structure of the exterior glass pane 150 generates heat, which raises the temperature of the exterior glass pane 150, and specifically the temperature of the first surface 151, above the dew point of the ambient environment 148.

The interior glass pane 160 includes a first surface 161 that faces away from the product display area 114, and a second surface 162 that faces toward and is exposed to the product display area 114. The interior glass pane 160 is formed of tempered glass, which is heat-treated glass heated above the annealing temperature and rapidly cooled, forming an outer glass layer with compressive stresses surrounding an inner glass layer in tension. Tempered glass, when broken, fragments into relatively small pieces less likely to injure someone and is frequently used instead of annealed glass in applications requiring such safety.

With continued reference to FIG. 3, the interior glass pane 160 includes a heated coating 180 affixed or applied on the first surface 161. The heated coating 180 provides resistance heating to the interior glass pane 160 via electrical power from a power source (not shown) to which the heated coating 180 is connected. As illustrated, the heated coating 180 is affixed to the first surface 161, rather than the second surface 162 of the interior glass pane 160, to minimize the possibility of electrical shock to a consumer. The heat provided to the interior glass pane 160 by the heated coating 180 quickly removes or "de-fogs" condensation formed on the second surface 162 when the door 130 is opened.

FIGS. 3 and 4 show that the intermediate glass pane 170 is spaced apart from the exterior glass pane 150 and the interior glass pane 160. The intermediate glass pane 170 includes a first surface 171 that faces away from the product display area 114 and toward the second surface 152, and a second surface 172 that faces toward the product display area 114 and toward the first surface 161. The intermediate glass pane 170 can be formed from any suitable glass material (e.g., annealed glass).

With reference to FIG. 3, the first surface 171 of the intermediate glass pane 170 includes a low emissivity ("low-e") coating 182. The low-e coating 182 of the first surface 171 reflects a portion of the radiation that passes through the exterior glass pane 150 back in the direction of the exterior glass pane 150. A portion of this reflected radiation will be absorbed by and further raise the temperature of the exterior glass pane 150. As illustrated, the second surface 172 includes a low-e coating 184 that reflects a portion of radiation that has passed through the exterior glass pane 150, the low-e coating 182, and the glass structure of the intermediate glass pane 170, maximizing the potential radiation absorbed by the exterior glass pane 150 while minimizing the amount of radiation that reaches the product display area 114.

Referring to FIG. 4, the door frame 134 provides support for the glass assembly 146 and can be formed of a flexible polyurethane. The door frame 134 includes a body 190, an outer flange 194 that contacts the first surface 151 of the exterior glass pane 150, and an inner flange 198 that contacts the second surface 162 of the interior glass pane 160. The outer flanges 194, 198 are bonded to the respective contacting surfaces 151, 162 using a formulated coating that bonds the polyurethane to the glass surfaces. The formulation used is preferably Chemlok® 144 Primer manufactured by LORD Corporation and allows the glass to flex to a different degree than the polyurethane without breaking the bond formed between them.

The door frame 134 also includes an insert 200 that separates and spaces the exterior glass pane 150, the interior glass pane 160, and the intermediate glass pane 170 from each other and from the door frame 134. The insert 200 wraps around the perimeter of the glass panes 150, 160, 170, and includes an outer spacer 204 and an inner spacer 208. The spacers 204, 208 are sized to define a first space 212 between the exterior glass pane 150 and the intermediate glass pane 170, and a second space 216 between the interior glass pane 160 and the intermediate glass pane 170. The first and second spaces 212, 216 can have any suitable dimension (e.g., approximately 0.5" between the second surface 152 of the exterior glass pane 150 and the first surface 171 of the intermediate glass pane 170, and between the second surface 172 of the intermediate glass pane 170 and the first surface 161 of the interior glass pane 160). The first and second spaces 212, 216 between the glass panes 150, 160, 170 can be filled with any suitable air or non-reactive gas (e.g., nitrogen). As will be appreciated by one of ordinary skill in the art, a relatively small space between glass panes 150, 160, 170 may result in greater heat transfer within the space, while a relatively large space may promote convection within the space.

An exterior portion 220 of spacer 204 engages the surface 152 of exterior pane 150 while an exterior portion 222 of spacer 208 engages the surface 161 of interior pane 160. Interior portions 224, 226 of spacers 204, 208 engage surface 171 and surface 172, respectively, of intermediate pane 170. A bridge 236 contacts the top and bottom edges 174, 176 of intermediate pane 170. A first projection 240 contacts the top and bottom edges 154, 156 of exterior pane 150 and a second projection 244 contacts the top and bottom edges 164, 166 of interior pane 160. Each of the spacers 204, 208 provides sealing contact between the door frame 134 and the glass panes 150, 160, 170 to limit infiltration of ambient air into the product display area 114. Each spacer 204, 208 can be filled with a desiccant 250 or other hygroscopic material, and is in fluid communication with one of the first and second spaces 212, 216 to attract and retain any moisture within the first and second spaces 212, 216. Aluminum tape 260 can be applied to the insert 200 to provide an additional barrier to moisture entering first and second spaces 212, 216.

A portion of the heat absorbed by the exterior glass pane 150 transfers to the door frame 134 and heats the door frame 134. Specifically, a portion of the heat absorbed by the exterior glass pane 150 will be transferred to the outer flange 194, and consequently to an exterior surface 270 of the door frame 134. As described above, heating the exterior glass pane 150, and in particular the first surface 151, as well as the exterior surface 270 of the door frame 134 above the dew point of the ambient environment 148 prevents formation of condensation on both surfaces.

The insert 200 is formed of a substantially flexible material (e.g., polypropylene) to provide a flexible partition between panes 150, 160, and 170, and the door frame 134. The exterior glass pane 150 expands in size as it is heated, and the flexibility of the door frame 134 and the insert 200 accommodates this expansion without producing excessive stresses within glass assembly 146. Additionally, the flexible nature of the door frame 134 and the insert 200, which positions and secures the intermediate glass pane 170 within the glass assembly 146, allows for relative movement between glass panes 150, 160, and 170. The flexible spacer 204, first projection 240, and bridge 236 allow for relative movement between the exterior glass pane 150 and the intermediate glass pane 170 due to expansion and retraction of exterior glass pane 150. Similarly, the flexible spacer 208, second projection 244, and bridge 236 allow for relative movement between the interior glass pane 160 and the intermediate glass pane 170 due to expansion and retraction of interior glass pane 160. This relative movement between glass panes 150, 160, and 170 further minimizes stresses within the glass assembly 146.

In operation, some incident radiation from the ambient environment 148 is directly absorbed by the heat absorbing exterior glass pane 150. The incident radiation not absorbed by the exterior glass pane 150 passes through the exterior glass pane 150 and is reflected by one or both of the low-e coatings 182, 184 of the intermediate glass pane 170 back toward the exterior glass pane 150. The reflected incident radiation increases the overall percentage of incident radiation absorbed by exterior glass pane 150. The absorption of additional incident radiation by the exterior glass pane 150 produces more heat within exterior glass pane 150, which raises the temperature of both the first surface 151 of exterior glass pane 150 and the exterior surface 270 of the door molding 134. The increased temperature on the first surface 151 and the exterior surface 270 minimizes or prevents the formation of condensation on the surfaces 151, 270.

The heated coating 180 heats the interior glass pane 160 to de-fog any condensation that forms on the second surface 162 of interior pane 160. Power can be supplied to the heated coating 180 continuously or at predetermined intervals. With no external power needed to obtain the thermal benefits associated with the exterior glass pane 150, the glass panes 150, 160, 170 cooperate with each other to provide an effective, safe, and low-cost way to eliminate condensation on the glass assembly 146 and the door frame 134.

Various features and advantages of the invention are set forth in the following claims.

The invention claimed is:

1. A door for a refrigerated merchandiser including a case defining a product display area, the door comprising:

a frame;

a first glass pane coupled to the frame and having heat-absorbing glass, the first glass pane configured to be positioned adjacent an ambient environment surrounding the refrigerated merchandiser to absorb radiation from the ambient environment;

a second glass pane coupled to the frame and configured to be positioned adjacent the product display area, the second glass pane having a conductive coating; and a third glass pane positioned between and spaced from the first glass pane and the second glass pane, the third glass pane having a low emissivity coating.

2. The door of claim 1, wherein the conductive coating is affixed to a surface of the second glass pane configured to face away from the product display area.

3. The door of claim 2, wherein the low emissivity coating is affixed to a surface of the third glass pane configured to face toward the ambient environment.

4. The door of claim 2, wherein the low emissivity coating is affixed to a surface of the third glass pane configured to face toward the product display area.

5. The door of claim 1, wherein the low emissivity coating is affixed to a first surface of the third glass pane configured to face toward the ambient environment, and wherein the third glass pane further has another low emissivity coating affixed to a second surface of the glass pane configured to face toward the product display area.

6. The door of claim 1, wherein the conductive coating is configured to be coupled to a power source to heat the second glass pane.

7. The door of claim 1, wherein the frame is formed from a flexible material such that the frame yields to accommodate expansion of the first glass pane.

8. The door of claim 1, further comprising a first spacer positioned between the first glass pane and the third glass pane, and a second spacer positioned between the second glass pane and the third glass pane.

9. The door of claim 8, wherein the first spacer and the second spacer are formed from a flexible material such that a flexible partition is provided between the first glass pane and the third glass pane, and between the second glass pane and the third glass pane.

10. The door of claim 9, further including a flexible bridge between the first spacer and the second spacer and in contact with the third glass pane, wherein the first glass pane and the second glass pane are configured to move relative to the third glass pane.

11. A refrigerated merchandiser comprising:

a case defining a product display area;

a door coupled to the case and enclosing a portion of the product display area, the door including a frame;

a first glass pane coupled to the frame and having heat-absorbing glass, the first glass pane positioned adjacent an ambient environment surrounding the refrigerated merchandiser to absorb radiation from the ambient environment;

a second glass pane coupled to the frame and positioned adjacent the product display area, the second glass pane having a conductive coating; and a third glass pane positioned between and spaced from the first glass pane and the second glass pane, the third glass pane having a low emissivity coating.

12. The door of claim 11, wherein the conductive coating is affixed to a surface of the second glass pane configured to face away from the product display area.

13. The door of claim 12, wherein the low emissivity coating is affixed to a surface of the third glass pane configured to face toward the ambient environment.

14. The door of claim 12, wherein the low emissivity coating is affixed to a surface of the third glass pane configured to face toward the product display area.

15. The door of claim 11, wherein the low emissivity coating is affixed to a first surface of the third glass pane configured to face toward the ambient environment, and wherein the third glass pane further has another low emissivity coating affixed to a second surface of the glass pane configured to face toward the product display area.

16. The door of claim 11, wherein the frame is formed from a flexible material such that the frame yields to accommodate expansion of the first glass pane.

17. The door of claim 11, further comprising a first spacer positioned between the first glass pane and the third glass pane, and a second spacer positioned between the second glass pane and the third glass pane, wherein the first spacer and the second spacer are formed from a flexible material such that a flexible partition is provided between the first glass pane and the third glass pane, and between the second glass pane and the third glass pane.

* * * * *